US006425511B1

(12) United States Patent
Dodson

(10) Patent No.: US 6,425,511 B1
(45) Date of Patent: Jul. 30, 2002

(54) MASONS TOOL CARRIER

(76) Inventor: John C. Dodson, 1336 Atkinson St., Henderson, KY (US) 42420

( * ) Notice: Subject to any disclaimer, the term of this patent is extended or adjusted under 35 U.S.C. 154(b) by 0 days.

(21) Appl. No.: 09/561,890

(22) Filed: May 1, 2000

(51) Int. Cl.[7] ..... A45F 3/00

(52) U.S. Cl. ..... 224/684; 224/677; 224/678; 224/242; 224/270; 224/904

(58) Field of Search ..... 224/195, 660, 224/677, 678, 680, 682, 684, 242, 251, 268, 270, 904

(56) References Cited

U.S. PATENT DOCUMENTS 2,528,501 A * 11/1950 Davis ..... 224/232
2,738,909 A * 3/1956 Shadoin et al. ..... 224/615
3,343,735 A * 9/1967 Breeding et al. ..... 224/242
4,307,825 A * 12/1981 Pattermann ..... 224/231
4,414,744 A * 11/1983 Collins ..... 30/151
5,450,994 A * 9/1995 Maiinowski ..... 224/666
5,582,338 A * 12/1996 Tamura ..... 224/678
5,673,830 A * 10/1997 Matthews ..... 224/268
5,992,716 A * 11/1999 Riley ..... 224/251

* cited by examiner

*Primary Examiner*—Stephen K. Cronin
(74) *Attorney, Agent, or Firm*—Gary K. Price, Esq.

(57) ABSTRACT

A masons tool carrier comprising a back piece with a front piece attached to form a pocket for carrying a margin trowel, a support for mounting and carrying a float, and clearances to permit the tool carrier to be carried on a person's belt.

2 Claims, 3 Drawing Sheets

MASONS TOOL CARRIER

CROSS REFERENCES TO RELATED APPLICATIONS

None

Statement as to rights to inventions made under Federally sponsored research and development: Not Applicable.

BACKGROUND OF THE INVENTION

1. Field of the Invention

This invention relates to a device that serves as a tool carrier of primary interest to masons. The tool carrier can carry, transport and store a margin trowel and a float. The tool carrier can be conveniently carried on a tool belt by a mason as he or she plies his or her trade.

2. Background Information

While tool carriers for hammers, pliers, and all sorts of tools exist for other trades, applicant could not find a commercially available, convenient way to carry his margin trowel and float while plying his trade.

As will be seen from the subsequent description, the preferred embodiments of the present invention overcome shortcomings of prior art.

SUMMARY OF THE INVENTION

The present invention is a device which, in the preferred embodiment, serves as a tool carrier for a margin trowel and a float which is a convenience for masons while plying their trade comprising a front piece and a back piece held together by rivets so that a pocket is formed that is suitable for carrying a margin trowel. The tool carrier further comprises clearance that permit said carrier to be carried on a belt. The device also comprises a float support attached to said carrier.

DESCRIPTION OF PREFERRED EMBODIMENTS

Figure 1:
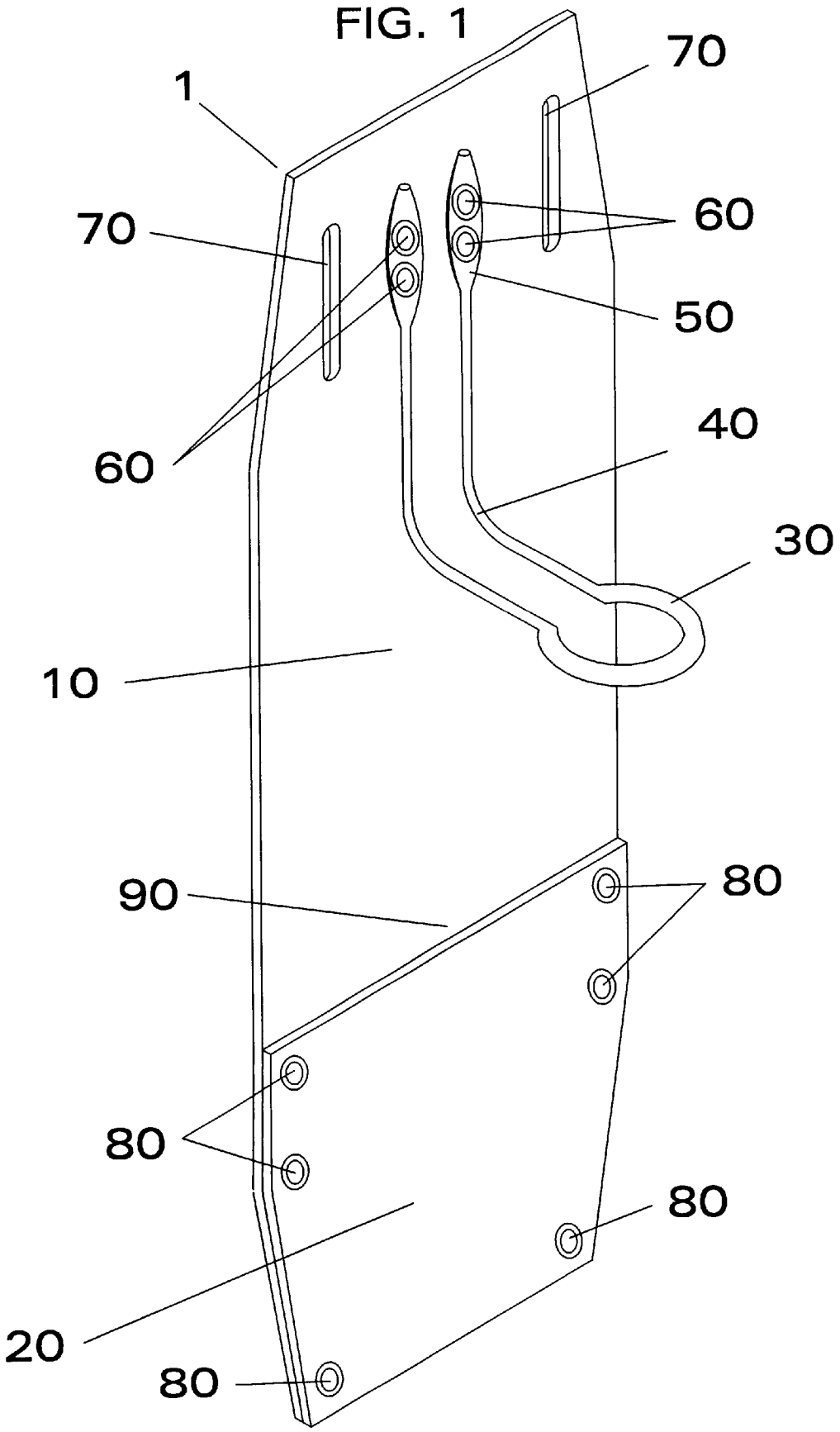
FIG. 1 is a front view of the present invention, a tool carrier.
Figure 2:
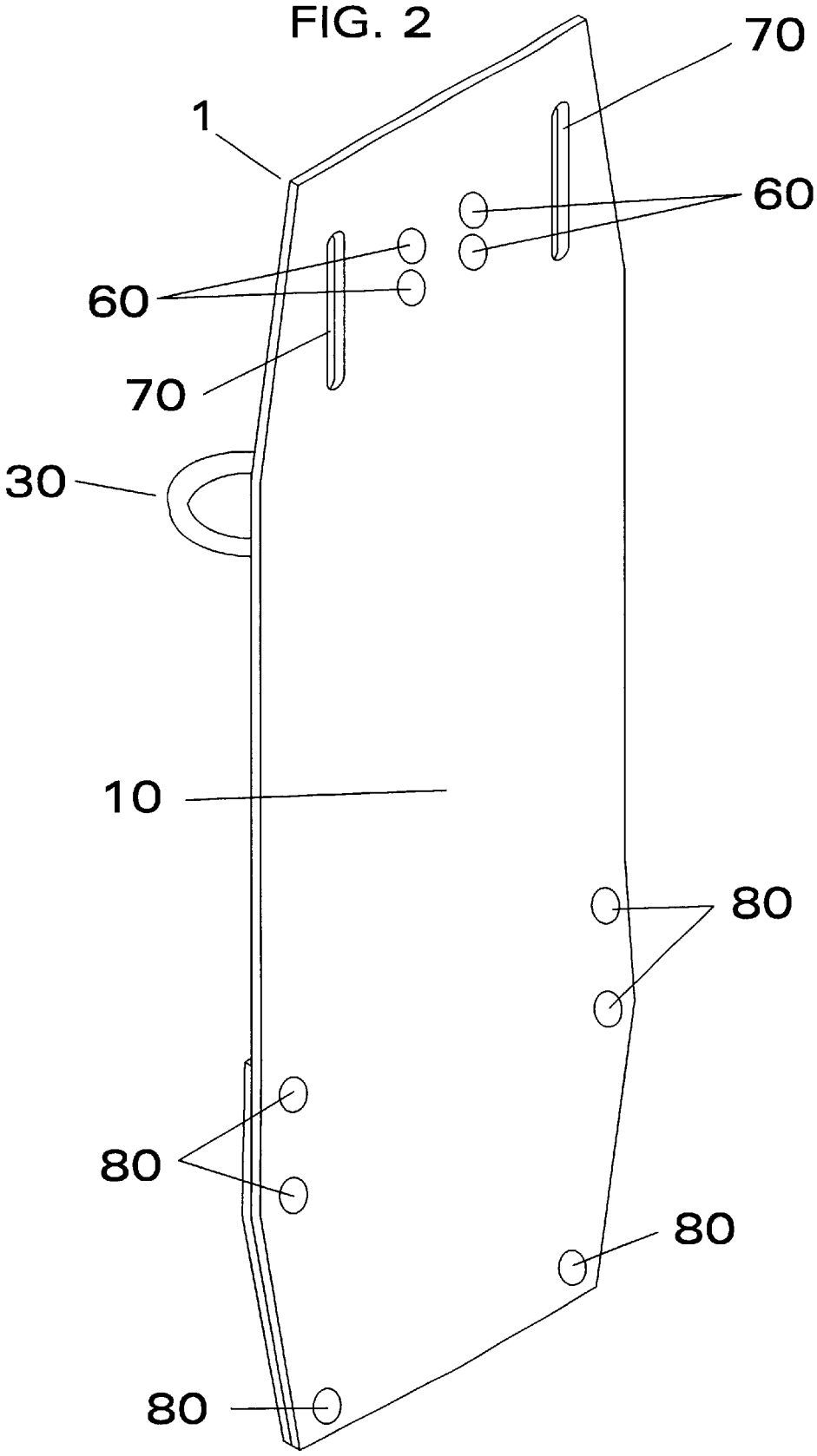
FIG. 2 is a back view of the present invention, a tool carrier.

FIGS. 1 and 2 illustrate the preferred embodiment of the present invention, a tool carrier 1 comprising a back piece 10, a front piece 20, a collar 30, a support 40, support rivets 60, clearances 70, rivets 80, and a pocket 90 which is formed by attaching the front piece 20 to the back piece 10 by means of the rivets 80.

The support 40 comprises the collar 30 extended outward from the tool carrier 1 as well as ends 50 which are attached to said carrier 1 by said support rivets 60.

The clearances 70 of the tool carrier 1 permit said carrier 1 to be carried by a person's belt.

Figure 3:
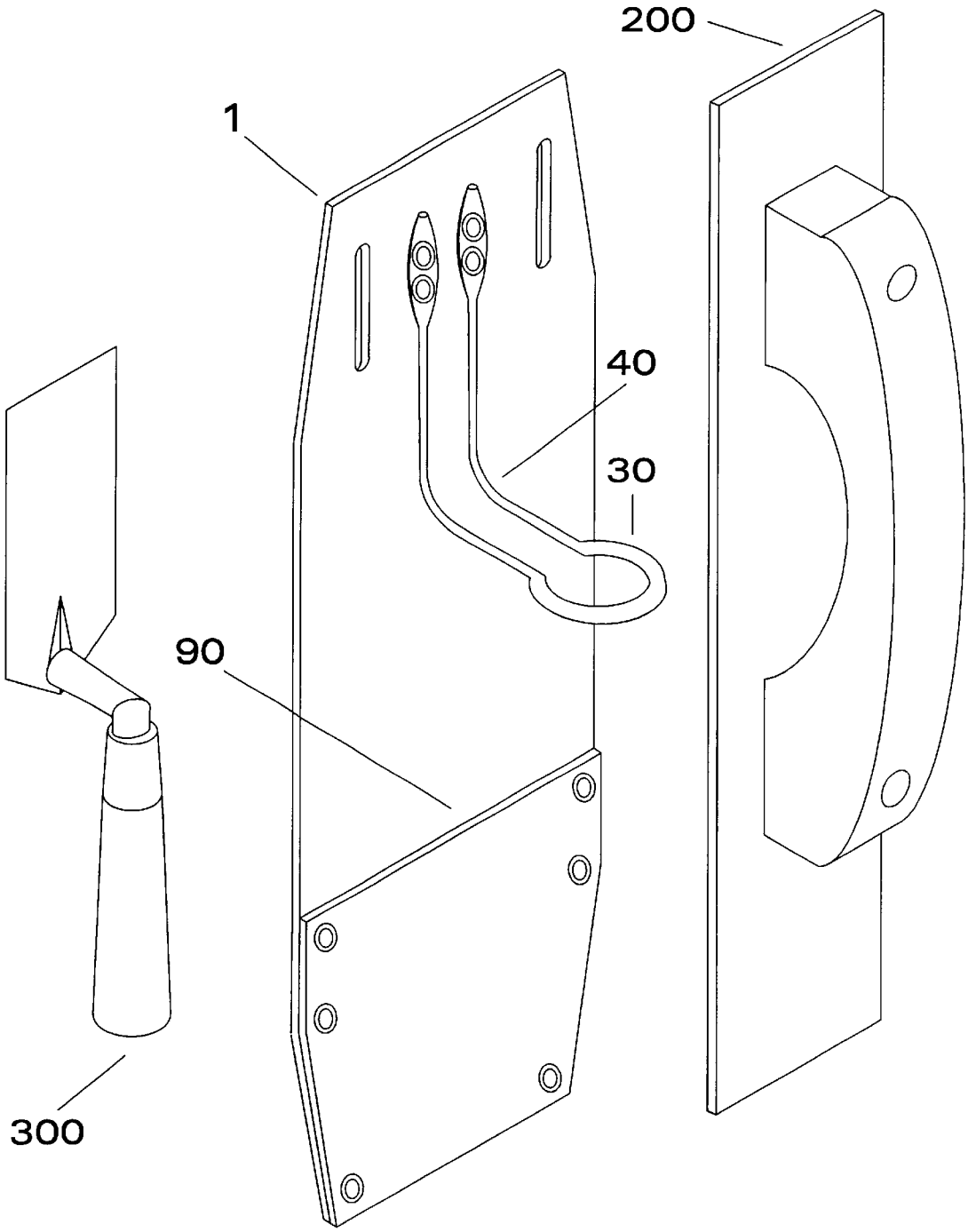
FIG. 3 illustrates a use of the tool carrier.

FIG. 3 illustrates an intended use of the tool carrier 1. A prior art float 200 can be mounted over the collar 3 0 of the support 40. A prior art margin trowel 300 can be inserted into the pocket 90.

In the preferred embodiment of the present invention, the material of construction of the back piece 10 and the front piece 20 is leather. As obvious to anyone skilled in the art, a fabric such as canvass or a flexible plastic might serve, albeit not as well.

The support 40, in the preferred embodiment, is of metal, preferably steel wire. As obvious to anyone skilled in the art, other materials might suffice, albeit not as well.

Although the description above contains many specificities, these should not be construed as limiting the scope of the invention but as merely providing illustrations of some of the presently preferred embodiments of this invention.

For example, tubular rivets are the preferred embodiment for the support rivets 60 and the rivets 80 which serve as means of attachment. However, as obvious to anyone skilled in the art, other means of attachment are possible, such as sewing the front piece 20 to, the back piece 10, or other types of fasteners, such as solid rivets or screws with nuts.

Also, the mason may only require carrying a float rather than a margin trowel and float. As obvious to anyone skilled in the art, the back piece 10 of the tool carrier 1 may be severed just below the support 40 and above the front piece 20, thereby omitting the pocket 90.

Also, in the preferred. embodiment, the front piece 20 and the back piece 10 are shown as two separate pieces which are joined together to form the pocket 90. As obvious to anyone skilled in the art, a single piece of fabric, folded, would serve the same purpose, although might be more prone to stress cracking at the fold.

Thus the scope of the invention should be determined by the appended claims in the formal application and their legal equivalents, rather than by the examples given.

I claim:

1. A device which is a carrier for a mason's trowel and a mason's float, said mason's trowel having a small flat blade and said mason's float having a large rectangular flat blade and a handle mounted to said rectangular flat blade in such a manner defining an opening, said carrier device comprising:

a back piece having two clearance slots near a top edge of said back piece, a support with at least one end attached to said back piece and disposed between the two clearance slots, a collar attached to said support and outwardly projecting from said back piece, a pocket formed by attaching a front piece to said back piece at their edges, said pocket positioned lower than the support, wherein the collar having a diameter substantially larger than the opening of said mason's float when said mason's float is in a vertical position, and wherein the collar having a diameter smaller than the opening of said mason's float when said mason's float is in a horizontal position.

2. The carrier device as recited in claim 1, wherein the collar will slip through the opening of said mason's float in a first position, and in other positions will not.

* * * * *